US005995020A

United States Patent [19]

Owens et al.

[11] Patent Number: 5,995,020

[45] Date of Patent: Nov. 30, 1999

[54] DOWNHOLE POWER AND COMMUNICATION SYSTEM

[75] Inventors: Steve Owens, The Woodlands; Gary Elliott, Magnolia, both of Tex.

[73] Assignee: PES, Inc., The Woodlands, Tex.

[21] Appl. No.: 08/544,125

[22] Filed: Oct. 17, 1995

[51] Int. Cl.[6] ..... H01V 3/00

[52] U.S. Cl. ..... 340/854.9; 340/855.3; 340/855.4; 340/855.8; 175/40; 166/250.01

[58] Field of Search ..... 340/854.9, 855.2, 340/855.3, 855.4, 855.5, 855.8; 175/40; 166/250.01

[56] References Cited

U.S. PATENT DOCUMENTS

| | | | |
|---|---|---|---|
| 4,689,620 | 8/1987 | Wondrak | 340/855.4 |
| 4,995,058 | 2/1991 | Byers et al. | 375/23 |
| 5,515,038 | 5/1996 | Smith | 340/853.3 |
| 5,515,039 | 5/1996 | Delattore | 340/854.9 |
| 5,539,375 | 7/1996 | Atherton | 340/854.9 |

*Primary Examiner*—J. Woodrow Eldred

[57] ABSTRACT

An apparatus for transmitting electricity between downhole well tools and the well surface. The apparatus incorporates a surface controller in combination with a conductor and a downhole receiver module. A choke prevents electricity from the controller from entering a high voltage DC power source, and a downhole regulator converts high voltage, low current power into high current, low voltage power. This feature of the invention permits a single wire to transmit sufficient power to operate multiple downhole well tools. The controller also includes a transmitter and a modulator operable to generate an electric signal representating at least two states, wherein a first state is represented by a signal, and wherein a second state is represented by the absence of an electric signal. A receiver module receives the electric signals and selectively transmits commands to the associated well tool or to the surface controller. In a two conductor wire, the conductors are evenly spaced so that attenuation of the signals is reduced. The controller can transmit a signal unique to a well tool which is selectively identified by the receiver module for operation of a specific well tool.

14 Claims, 2 Drawing Sheets

DOWNHOLE POWER AND COMMUNICATION SYSTEM

BACKGROUND OF THE INVENTION

The present invention relates to the field of operating a downhole tool string in a well. More particularly, the present invention relates to an improved system for providing electric power to downhole instruments and other tools and for transmitting electric signals from such tools to the well surface.

Downhole well instruments and other tools are positioned in hydrocarbon producing wells to detect well conditions and to control the operation of the well. Although fluid pressure communication systems have been developed to communicate between the well surface and downhole tools positioned at great depths below the well surface, such systems are affected by distortions within the well fluid and by delays in data transmission.

To avoid the problems associated with fluid based communication systems, metallic wire conductors communicate electric power and signals between the well surface and subsurface well equipment. In one example, U.S. Pat. No. 5,236,047 to Pringle et al. (1993) disclosed multiple well tools connected to a surface controller with multiple electric conductors. A separate electric conductor or signal line was connected between each downhole tool and the well surface. In a large installation having numerous downhole tools, the large space required by multiple hard wires and the plurality of wire failure paths restricts the usefulness of this concept.

The hard wires for communicating electricity to downhole tools are commonly referred to as I-wires. A separate I-wire is connected between well surface equipment and the downhole well tool. One type of tool comprises a pressure and temperature transducer, which typically produces one frequency for pressure and one frequency for temperature. A regulated voltage is transmitted through the I-wire from the well surface to the pressure and temperature transducer, and a linear regulator converts the voltage to the voltage required by the pressure and temperature transducers. Pressure and temperature signals are transmitted to the well surface with time division multiplexing techniques. The pressure signal from the pressure transducer is transmitted to the well surface by modulating the current in the I-wire. Similarly, the temperature signal from the temperature transducer is transmitted to the well surface by modulating the current in the I-wire when the pressure transducer is not transmitting.

This technique can be used for a single well tool such as the pressure and temperature transducer described. However, this technique has certain limitations. If another gauge or tool is positioned in the well, an additional I-wire must be installed. This increases the cost and requires the use of multiple I-wires in a wire array. Additionally, the electric signals can only be transmitted in one direction, such as from the downhole tool to the well surface. This limitation on the transmission of signals reduces the flexibility of the system for communicating information.

Certain limitations of the technique described above have been reduced in applications combining a pressure and temperature gauge and another tool such as a gas lift valve. In one example, a frequency band transmitted data from a pressure and temperature gauge, and a different frequency band transmitted data from the gas lift valve. To operate the gas lift valve, the current was reversed through the I-wire. To supply the substantially higher electric current required by the gas lift valve, the voltage was raised to overcome the current transmission losses caused by the resistivity of the I-wire. To prevent the high voltage from destroying the gauge, a diode was positioned in series with the gauge load to block the reversed line voltage.

Although this concept can permit a power and signal transmission on a single I-wire, the number of systems attachable to the I-wire is limited by the bandwidth of the I-wire. Moreover, the concept limits the commands to a single downhole tool at a time, which encumbers the ability to perform multiple simultaneous functions.

Accordingly, a need exists for a system for two-way transmission of signals and electric power between the well surface and downhole well tools. The system should be able to transmit different types of information and electric signals and should be able to meet different power requirements of downhole tools.

SUMMARY OF THE INVENTION

The present invention provides an apparatus for transmitting electricity between a downhole well tool and the well surface. A controller is located at the well surface, a receiver module is engaged with the well tool, and a conductor is connected to the controller and the receiver module. A choke is positioned for selectively preventing electricity flow. A second conductor can be connected between the controller and the receiver module, the second conductor can be equally spaced from the first conductor, and the receiver module can communicate electric signals to the controller.

In other embodiments of the invention, the controller includes a communication transmitter operable to generate an electric signal representing at least two states, and a modulator is connected between the transmitter and the receiver module. The modulator transmits an electric signal from the transmitter to the conductor, wherein a first state is represented by an electric signal and a second state is represented by the absence of a signal. In another embodiment of the invention, a regulator is attached to the conductor for modifying the electricity transmitted to the well tool.

In another embodiment of the invention, the transmitter is operable to transmit at least one bit representative of a flag and one bit representative of data. The flag bit is used by the well tool to determine is the associated data is to be interpreted as an address or a command. Each downhole tool has a unique address such that only one tool is responsive to a specific address.

DESCRIPTION OF THE PREFERRED EMBODIMENTS

Figure 1:
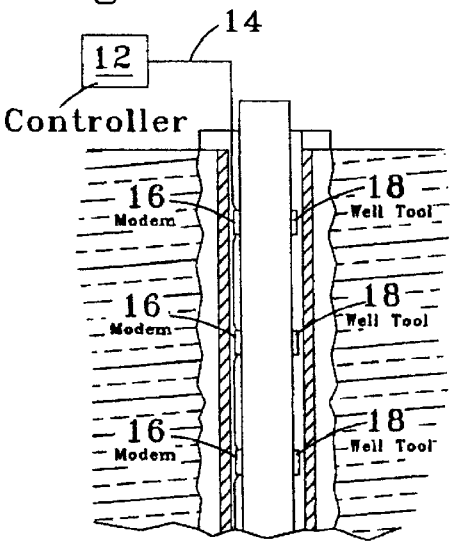
FIG. 1 illustrates the position of the invention relative to a wellbore.

The present invention provides an apparatus for transmitting electric power and electric signals between a subsurface well tool and the well surface. Referring to FIG. 1, the present invention is illustrated in wellbore 10 and is generally identified as a surface interface unit shown as controller 12, two conductor wire 14, and receiver module or power modem 16 engaged with downhole well tools 18. As used herein, the term "tool" is defined as including a wide range of sensors, gauges and equipment, including but not limited to temperature sensors, flow meters, pressure transducers, density sensors, packers, sliding sleeves, control valves, injection ports, gas lift valves, and any other instruments or devices in a wellbore.

Figure 2:
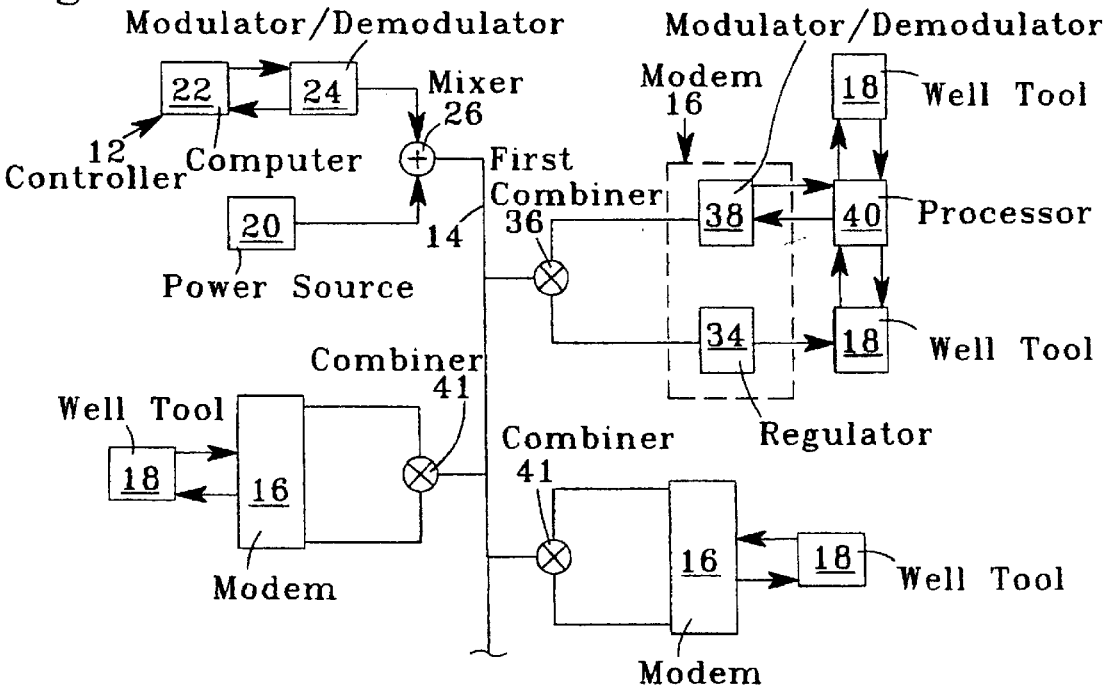
FIG. 2 illustrates a schematic view of the invention.

Referring to FIG. 2, a comunication signal from controller 12 is mixed with high voltage DC from power source 20. Controller 12 includes general purpose computer 22, modulator/demodulator 24, and mixer 26. Computer 22 can comprise any computer system having a keyboard or other operator interface, a display screen, and a communication port (not shown). Computer 22 generates commands requested by the operator and displays information for review by the operator.

Command signals generated on computer 22 by an operator are combined with a modulation signal in mixer 26, the modulation signal is mixed with the high voltage from DC power source 20, and the combined signal is applied to wire 14. In this fashion, wire 14 simultaneously transmits electric power and communication signals.

Figure 3:
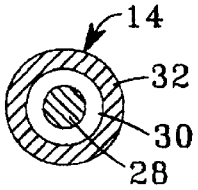
FIG. 3 illustrates a crossectional view of an I-wire.

Referring to FIG. 3, wire 14 is illustated in one embodiment as an I-wire comprising first conductor 28, insulation 30, and control line or second conductor 32. First conductor 28 is suitable for conducting current from controller 12 to one or more power modems 16, and current is returned to controller 12 through second conductor 32. First conductor 28 can comprise an electricity conducting material such as copper or aluminum. Second conductor 32 can comprise a corrosion resistant material such as Inconel and prevents fluids from contacting insulation 30 and first conductor 28. Insulation 30 can comprise an insulating material such as Teflon and further prevents first conductor 28 and second conductor 32 from electrical shortcircuits.

Insulation 30 also maintains a constant spacing between first conductor 28 and second conductor 32 along the entire length of first conductor 28. In a preferred embodiment of the invention as illustrated, equal spacing of the conductors is accomplished by maintaining first conductor 28 concentric with the outer tube forming second conductor 32. The uniformity of spacing between first conductor 28 and second conductor 32 is important to the efficient operation of the invention because the length of conductors 28 and 32 is great. If insulation 30 was nonuniform, the distance between first conductor 28 and second conductor 32 would vary over distance and would create an impedance upset. Such upset would reflect a portion of the modulation signal, thereby creating standing waves interfering with communication signals on first conductor 28 and second conductor 32. The interference created by such standing waves is undesirable because such interference can attenuate and distort the communication signals and cause regulator 34 to be unstable.

As illustrated by the schematic diagram in FIG. 2, the invention permits signal communication through wire 14 in addition to power transmission. Command signals from computer 22 are combined with a modulation signal in modulator/demodulator 24, are further combined with high DC voltage with mixer 26, and are communicated through first conductor 28. Such signals are transmitted through first combiner 36, are demodulated through modulator/demodulator 38, and are received by embedded processor 40. The same signal or series of signals are received by additional combiners 41 and a different embedded processor (not shown) associated with other well tools 18. Depending on the address and command sent by controller 12 as described below, embedded processor 40 can do nothing (not addressed), can send data back to controller 12, or can perform a selected control function.

Because first conductor 28 has an impedance greater than zero, the maximum power that can be supplied to each power modem 16 is the power from DC source 20 minus the power consumed by the impedance of first conductor 28. Such power loss equals the current squared multiplied by the impedance of first conductor 28. Referring to FIG. 2, power modem 16 can convert high voltage, low current power in wire 14 to a lower voltage and higher current. Such conversion to low voltage is desirable because electronic circuits and other electrical devices typically require low supply voltage. Regulator 34 provides this conversion, and permits the operation of tools requiring relatively high current such as motors, solenoids, and other devices.

Regulator 34 preferably comprises a regulator that does not function as a linear regulator. A linear regulator is undesirable for such use because the power dissipated in a linear regulator is equal to the difference between the input and output voltages multiplied by the current flowing to the load, assuming fixed output voltages and current. Excessive power dissipation by linear regulators in a well control system would require a large heat sink and would reduce the reliability of the system.

Figure 4:
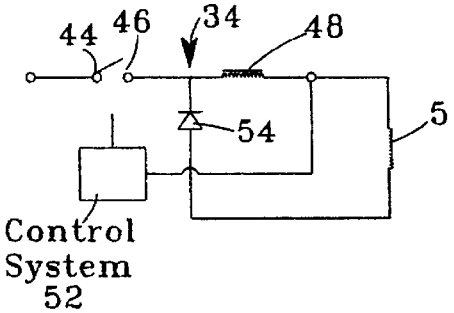
FIG. 4 illustrates one embodiment of a regulator for converting high voltage low current power to low voltage high current power.

FIG. 4 illustrates a schematic of one embodiment for regulator 34. High voltage is present at node 44, and electronic switch 46 is initially closed to cause current to flow into inductor 48. Because of inductance, voltage at load 50 will rise at a controlled rate. Control system 52 monitors the voltage increase in load 50. When voltage in load 50 reaches the desired voltage, switch 46 is opened by control system 52 and stored energy in inductor 48 will flow through load 50 and diode 54. Control system 52 monitors the drop in voltage at load 50 and turns on electronic switch 46 when the voltage falls below the desired voltage. This process is repeated, and power losses during such conversion are limited to the resistance of electronic switch 46, the resistance of inductor 48 and the loss in diode 54.

By using this feature of the invention, the output current can be greater than the input current. Consequently, downhole tools 18 requiring high current can be powered without the high current losses typically occurring in first conductor 28 at low voltage and high current. The electric power provided by first conductor 28 can be controlled to provide different electric currents and voltages to different tools 18 within the system. Additionally, the current and voltage distributed to each tool 18 can be detected by the respective power modems 16 and transmitted to computer 22. Computer 22 can process this information and can selectively operate tools 18 to reduce or increase the electric power required for each tool 18. In this fashion, the entire production system can be controlled so that the power transmitting capability of wire 14 is not exceeded. This feature of the invention accounts for the power consumption of each tool 18 and reduces the possibility of system failure.

Figure 5:
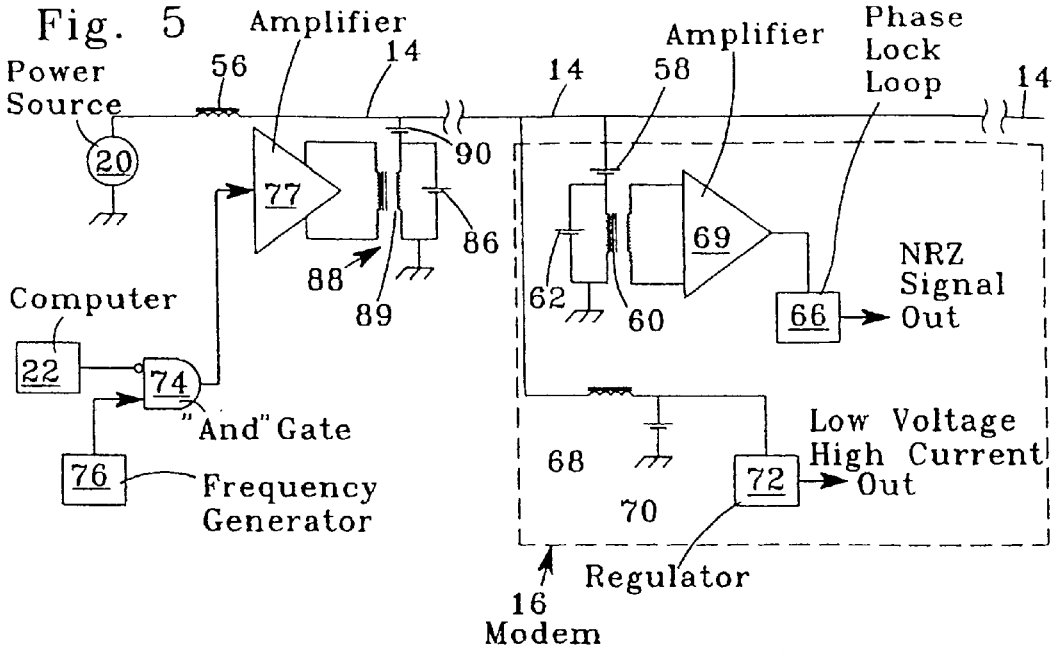
FIG. 5 illustrates a schematic view showing one embodiment of a communication system for the invention.

Referring to FIG. 5, one embodiment of receiver module or power modem 16 is illustrated. Power modem 16 can be configured as a distinct package attachable to wire 14 and engagable to well tool 18. In this fashion, power modem 14 uniquely provides the power and communication link between controller 12 and well tool 18.

As shown in FIG. 5, high voltage DC power source 20 would normally have a very low output impedance and would attenuate communication signals. To accommodate this condition, choke 56 permits the DC voltage to pass while preventing modulation current from entering DC power source 20. As illustrated, one embodiment of downhole power modem 16 can include capacitor 58, transformer 60, capacitor 62, amplifier 64, phase lock loop 66, choke 68, capacitor 70 and regulator 72. Capacitor 58 and the primary coil of transformer 60 combine to form a tuned circuit at the modulation frequency. Secondary voltage of transformer 60 is increased by amplifier 64 and is applied to phase lock loop 66. High DC voltage flows through choke 68 to regulator 72. Since regulator 72 will generate noise, choke 68 acts to isolate such noise from wire 14. Capacitor 70 is charged by DC voltage and is discharged when regulator 72 is switched.

Phase lock loop 66 is positioned for demodulating electric signals and is equipped with quadature phase detector so that when the modulation signal is present, quadrature detector is driven low to create a space as described below. In this fashion, a non return to zero (NRZ) signal from computer 22 is replicated in tool 18. As is known in the art, a NRZ signal is the output signal typically generated by a central processing unit such as computer 22. Similarly, the NRZ signal generated by embedded processor 40 can be sent to computer 22 by reversing the process described above.

As shown in FIG. 5, the NRZ signal is combined at "AND" gate 74 with a high frequency tone generated by high frequency generator 76. The NRZ signal from computer 22 has two states identified herein as a "mark" and a "space". The space mark is normally associated with a binary "0" and the mark state is normally associated with a binary "1". The NRZ signal can also be viewed as having a third state identified as "no information", and three modulation frequencies would normally be required to represent these three states. A significant teaching of the invention is that only one modulation frequency is necessary because two of the states are identical, and the lack or absence of a modulation frequency can signify the third state.

Figure 6:
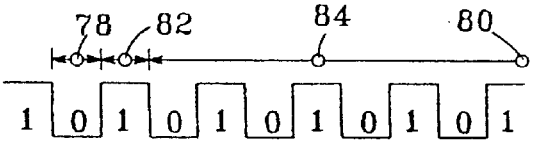
FIGS. 6 and 7 illustrate a communication sequence wherein the absence of a signal acts as a communication state.
Figure 7:
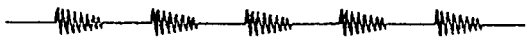

Significantly, the mark signal of the NRZ signal can also represent a "no-information" state when no information is being received. As shown in FIGS. 6 and 7, the start of a data word is initiated with a start bit positioned at 78. The end of a data word is stopped with a stop bit positioned at 80. FIG. 6 illustrates an address bit identified at 82 and further illustrates bit 84 identified as an NRZ pattern for the hexadecimal address 55. Cumulatively, bit 82 and bit 84 can be defined as comprising a "data word". If another word is to be sent, another start bit would proceed stop bit 80. However, if another word is not ready to be sent, the NRZ signal would remain in the mark state.

Typically, the signal threshold for the NRZ signal is greater than 5 volts for a mark and less than −5 volts for a space. The signal emanating from computer 22 is typically 15 volts for a mark and −15 volts for a space. Because these signals have a very high frequency content due to edge switching, such signals cannot be directly transmitted through wire 14 without being attenuated below the threshold voltage. This bandwidth problem can be overcome by modulating the signal so that the signal content in bandwidth is limited and travels with relatively low losses.

When the NRZ signal is low, thereby connoting a space, high frequency generator 76 is applied to amplifier 64 to drive coupling transformer 60. Capacitor 86 and secondary coil of coupling transformer 88 combine to form tuned circuit resonating at the modulation frequency of high frequency generator 76. Coupling 90 blocks DC voltage of high voltage generator 76 and allows modulation signal to be coupled to wire 14.

Figure 8:
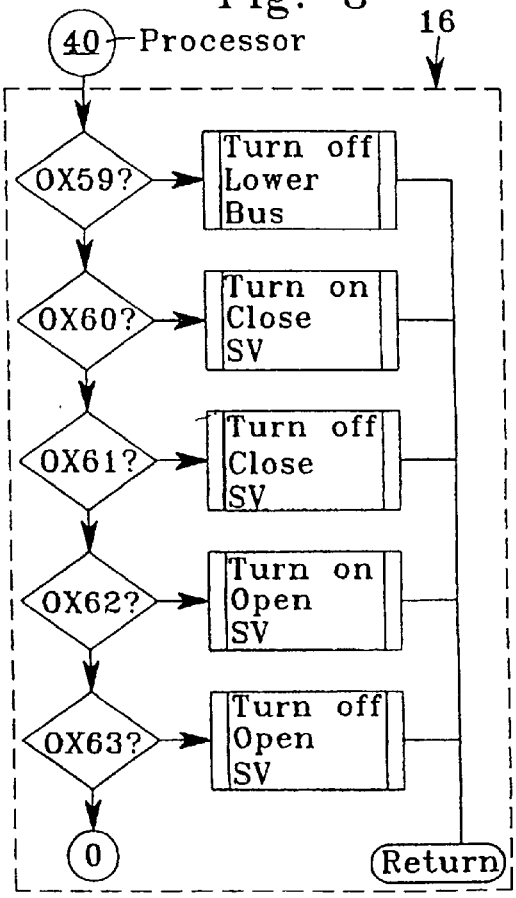
FIG. 8 represents one sequence of communication events disclosed by the invention.

The operation of each tool 18 can be initialized by identifying the address attendant with each tool 18. Referring to FIG. 8, an interrupt will be generated each time a completed data work is received by embedded processor 40.

Initially computer 22 will broadcast the address of tool 18 by setting the address bit. Each tool 18 can have a unique address, and each embedded processor 40 will first read the address flag 82. If address flag 82 is not set, the next transmission is awaited. If the address flag is set, the data word in the transmission is compared to the address of tool 18. If a match of tool 18 bit address 82 is detected, such information is transmitted back to computer 22. In this fashion, communication can be established between computer 22 and a specific downhole tool 18 without interference from other downhole tools 18 attached to wire 14.

After communication is established between computer 22 and a specific tool 18, computer 22 will transmit a command word. Only the addressed tool 18 is responsive to the command word, even though other tools 18 connected to wire 14 may have an identical command word. The addressed tool will transmit the command word back to computer 22 and will perform the required action. This action can include a control function or can involve the transmittal of data. Any transmittal of data can be followed by a check sum. As shown in FIG. 8, the flow chart illustrates a representative functional operation of power nodule 16 following commands from computer 22.

The present invention is useful in a well control system wherein a single or multiple well tools are installed downhole in a well. By using a single wire to transmit power and to communicate electrical signals, the simplicity and resulting reliability of a well control system can be achieved. A single wire requires less space downhole in a well, and problems associated with multiple seal connections are significantly reduced. Although each power modem 16 is illustrated as being associated with a single well, the present invention contemplates that a single downhole receiver module or power modem 16 could be engaged with multiple tools for receiving data and for transmitting signals to such multiple tools. As one representative example, a single power modem 16 could be engaged with a pressure transducer (not shown) to identify the well pressure in a discrete zone, and the same power modem 16 could communicate signals and power to operate a sliding sleeve or valve (not shown) for selectively opening or closing access to such well zone.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for transmitting electricity from an electricity source between a downhole well tool and the well surface, comprising:

a controller located at the well surface and engaged with the electricity source;

a conductor attached to said conductor for transmitting electricity;

a regulator attached to said conductor for modifying the electricity transmitted through said conductor and for transmitting the modified electricity to the well tool; and a second conductor attached to said controller, and further comprising at least two regulators each attached to said conductors and to a different well tool, wherein each regulator is capable of transmitting an electric signal to said controller.

2. An apparatus as recited in claim 1, wherein the electric signal transmitted by each regulator identifies the power transmitted to the respective well tool.

3. An apparatus as recited in claim 2, wherein said controller is capable of receiving such electric signals, of processing such electric signals to monitor the total electricity transmitted through said conductors, and of transmitting a signal to a regulator to modify the quantity of electricity transmitted by a regulator to a well tool.

4. An apparatus for transmitting electricity from an electricity source between at least two downhole well tools and the well surface, comprising:

a controller located at the well surface and engaged with the electricity source;

a conductor attached to said controller and to each well tool;

a transmitter operable to transmit a data word comprising at least two bits through said conductor, wherein at least one of said bits comprises a flag, and at least one of said bits comprises data; and a receiver module engaged between said conductor and each well tool, wherein each receiver module reviews said flag to determine whether said flag represents an address identifying a specific well tool.

5. An apparatus as recited in claim 4, wherein one of said well tools responds to said controller when said flag is set to identify an address corresponding to such well tool, and wherein said data bit corresponds to a preprogramed tool address stored in such well tool.

6. An apparatus as recited in claim 4, wherein said flag comprises an electric signal.

7. An apparatus as recited in claim 4, wherein said flag comprises the absence of an electric signal.

8. An apparatus as recited in claim 4, wherein said receiver module is capable of transmitting a signal to said controller.

9. An apparatus as recited in claim 8, wherein the signal transmittable by said receiver module identifies a well condition.

10. An apparatus as recited in claim 8, wherein the signal transmittable by said receiver module identifies a condition of the associated well tool.

11. An apparatus for communicating with a downhole well tool and for communicating with an electricity carrying conductor engaged with a surface controller operable to transmit a data word, comprising at least two bits, from the controller to two or more downhole well tools, comprising:

a receiver module engagable with a well tool for receiving the data word, wherein said receiver module is capable of identifying whether the data word correlates to said receiver module, and wherein such receiver is further capable of transmitting a preprogrammed signal to the engaged well tool.

12. An apparatus as recited in claim 11, wherein said receiver module is capable of transmitting an identification signal to the surface controller after said receiver module identifies that the data word correlates to said receiver module.

13. An apparatus as recited in claim 12, wherein said receiver module is capable of communicating directly with the surface controller after said receiver module transmits the identification signal to the surface controller.

14. An apparatus as recited in claim 11, wherein said receiver module is capable of identifying whether the first bit in the data word correlates to said receiver module.

* * * * *